US005142733A

United States Patent [19]

Mogel et al.

[11] Patent Number: 5,142,733

[45] Date of Patent: Sep. 1, 1992

[54] MAT HOLDERS

[75] Inventors: Philip Mogel, High Halden; John Calvert, Epping, both of Great Britain

[73] Assignee: Kimberly-Clark Corporation, Neenah, Wis.

[21] Appl. No.: 628,301

[22] Filed: Dec. 14, 1990

[30] Foreign Application Priority Data

Dec. 15, 1989 [GB] United Kingdom ..... 8928367

[51] Int. Cl.[5] ..... A47G 27/04; A47K 7/02

[52] U.S. Cl. ..... 16/8; 15/215

[58] Field of Search ..... 16/4, 8; 15/215, 216, 15/217

[56] References Cited

U.S. PATENT DOCUMENTS

| | | | |
|---|---|---|---|
| 918,396 | 4/1909 | Tracy . | |
| 1,633,951 | 6/1927 | O'Toole . | |
| 1,641,029 | 8/1927 | Gaudet . | |
| 2,187,676 | 1/1940 | Biewen | 4/252 |
| 2,343,037 | 2/1944 | Adelman | 160/382 |
| 2,644,977 | 7/1953 | June | 16/7 |
| 2,771,613 | 11/1956 | Markiewicz | 4/252 |
| 2,990,033 | 6/1961 | Arnold | 184/106 |
| 3,083,393 | 4/1963 | Nappi | 15/215 |
| 3,129,972 | 4/1964 | Vodra | 296/1 |
| 3,156,957 | 11/1964 | Moeckel | 20/78.3 |
| 3,158,962 | 12/1964 | Faase | 50/321 |
| 3,206,785 | 9/1965 | Heil | 15/215 |
| 3,220,469 | 11/1965 | Oehmig | 160/380 |
| 3,238,554 | 3/1966 | Mann, Jr. | 15/217 |
| 3,390,912 | 7/1968 | Stata | 296/1 |
| 3,400,421 | 9/1968 | Nappi et al. | 15/215 |
| 3,415,300 | 12/1968 | Worcester | 150/40 |
| 3,445,083 | 5/1969 | Moss | 248/350 |
| 3,488,081 | 1/1970 | Nolen | 296/1 |
| 3,501,797 | 3/1970 | Nappi | 15/215 |
| 3,578,738 | 5/1971 | Hughes | 15/215 |
| 3,654,064 | 4/1972 | Laumann | 161/156 |
| 3,665,543 | 5/1972 | Nappi | 15/215 |
| 3,717,897 | 2/1973 | Amos et al. | 15/215 |
| 3,729,045 | 4/1973 | MacDonald | 160/371 |
| 3,785,102 | 1/1974 | Amos | 52/173 |
| 3,856,610 | 12/1974 | Bruneel | 161/43 |
| 3,909,996 | 10/1975 | Ettlinger et al. | 52/177 |
| 4,029,834 | 6/1977 | Bartlett | 428/62 |
| 4,054,698 | 10/1977 | Hamrah | 428/40 |
| 4,125,656 | 11/1978 | Creamer | 428/80 |
| 4,143,194 | 3/1979 | Wihksne | 428/81 |
| 4,285,075 | 8/1981 | Nelson | 4/252 |
| 4,328,275 | 5/1982 | Vargo | 428/156 |
| 4,377,610 | 3/1983 | McClung, Jr. | 428/88 |
| 4,381,324 | 4/1983 | Ellingson, Jr. . | |
| 4,421,809 | 12/1983 | Bish et al. | 428/90 |
| 4,439,474 | 3/1984 | Sagel | 428/90 |
| 4,549,334 | 10/1985 | Miller | 29/278 |
| 4,564,546 | 1/1986 | Jones | 428/81 |
| 4,566,236 | 1/1986 | Pound | 52/222 |
| 4,609,580 | 9/1986 | Rockett et al. | 428/198 |
| 4,741,065 | 5/1988 | Parkins | 16/8 |
| 4,765,039 | 8/1988 | Rowlands et al. | 24/556 |
| 4,913,235 | 3/1980 | Cucchiara | 52/202 |
| 5,018,235 | 5/1991 | Stamatiou et al. | 15/215 |

FOREIGN PATENT DOCUMENTS

| | | |
|---|---|---|
| 0125618 | 5/1984 | European Pat. Off. . |
| 0260864 | 9/1987 | European Pat. Off. . |
| 0282278 | 3/1988 | European Pat. Off. . |
| 2329823 | 5/1977 | France . |
| 1171250 | 11/1969 | United Kingdom . |
| 1213875 | 11/1970 | United Kingdom . |
| 2065469 | 7/1981 | United Kingdom . |
| 2083352 | 3/1982 | United Kingdom . |

*Primary Examiner*—Robert L. Spruill
*Assistant Examiner*—Carmine Cuda
*Attorney, Agent, or Firm*—Joseph P. Harps; William D. Herrick

[57] ABSTRACT

A holder for a floor mat comprises at least one connecting device and at least one connecting member which has complementary connection devices whereby the connecting member may be connected in a releasable manner to at least two adjacent mat holders so as to secure the mat holders together. Preferably at least one of the holder or the connecting member are made from flexible material or are designed to be slightly flexible.

16 Claims, 2 Drawing Sheets

MAT HOLDERS

BACKGROUND OF THE INVENTION

This invention relates to mat holders generally and more particularly to holders for disposable floor mats.

Floor mats which are intended to be disposable may be made of paper or synthetic fabrics and rest directly on the floor. However, in this case, the mats tend to become displaced and/or torn and so do not adequately carry out the function for which they are designed. Holders have therefore been developed to hold the mats in position on the floor and to protect the edges of the mat. This greatly prolongs the life of each disposable mat.

One such mat holder is described in our European Patent Publication No 260864. The holder has a base on which the mat rests and side flaps which clamp the mat in place. The holder is then placed in the desired location. Another such holder is described in the Applicant's British Patent Application No. 8920349.

These mat holders are suitably manufactured in one piece and are usually made in a limited number of standard sizes. When a mat is required to cover an area greater than the maximum available size of a holder, more than one holder will therefore be required. With this arrangement, the holders tend to become separated when walked over, and so undesirably expose areas of the floor and also edges of the holder over which people may trip.

BRIEF SUMMARY OF THE INVENTION

In accordance with the invention a holder for a floor mat comprises at least one connecting means and at least one connecting member, which has complementary connection means whereby the connecting member may be connected in a releasable manner to at least two adjacent mat holders, so as to secure the holders together.

This allows two adjacent holders to be connected together in such a way that the holders are generally unable to be separated when a lateral force is exerted on the holder, for example when a person walks across the area of matting.

The connecting member may consist of an elongated body having connecting means at either end. The connecting means may be in the form of a lug, which cooperates with a complementary hole provided in the holder, or vice versa.

Alternatively, the connecting member may cooperate with connecting means which extend for a significant fraction of a side of the holder. A narrow channel may be provided in either the holder or the connecting member, with complementary connecting means, in the form of ridges or the like, being provided on the connecting member or holder respectively.

The connecting member may be made from a flexible material, for example rubber or a rubber substitute, or may be relatively stiff, for example, made of polypropylene or any other suitable plastics material. In the latter case, the connecting member may include at least one aperture between the connecting means of the member and these apertures may take the form of thin elongated slots which extend generally between the connecting means of the member.

These slots or apertures allow one end of a connecting member to move slightly relative to the other end, in a direction in the plane of the member perpendicular to the slots. This means that if the connecting means on adjacent holders are not directly opposite each other, as may be the case with holders from different manufacturing batches or plants, the connecting member may be attached to one holder, slightly twisted and attached to another mat holder.

Each mat holder may be provided with both forms of connecting means, but preferably only one form is provided.

It is preferred that at least one of the holder or the connecting member be flexible, so that the connection will yield slightly.

BRIEF DESCRIPTION OF THE DRAWINGS

The invention will now be described by way of example with reference to the accompanying drawings, in which.

DETAILED DESCRIPTION

Figure 1:
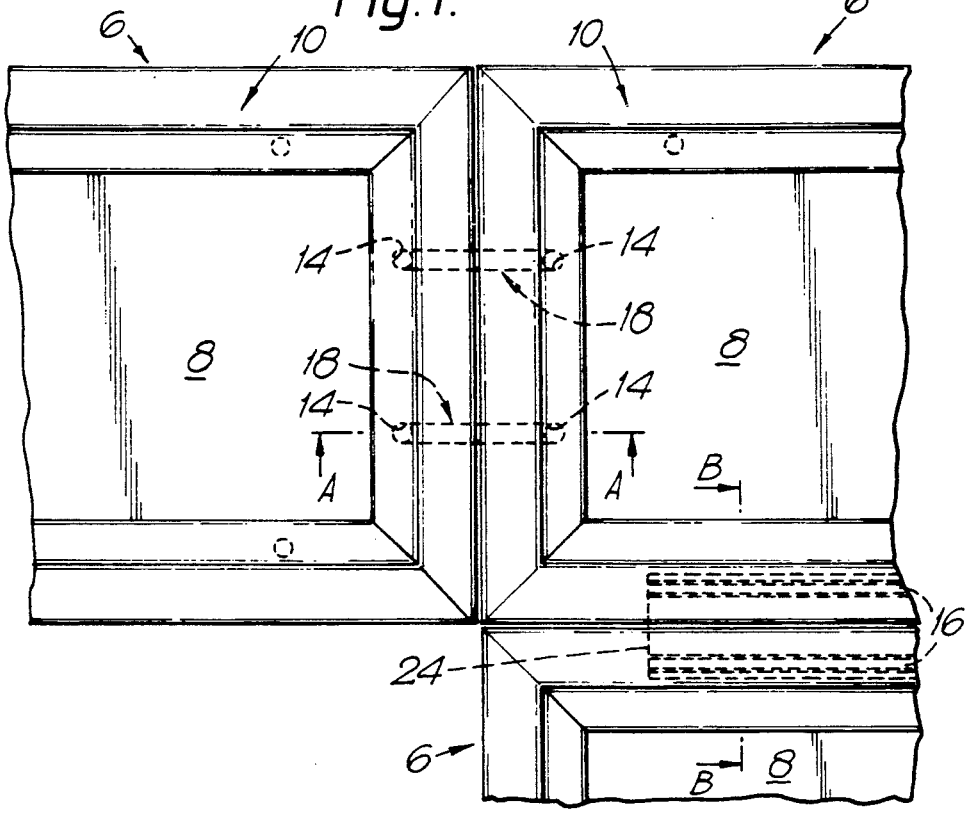
FIG. 1 is a partial plan view of three holders in accordance with two embodiments of the invention.

The figures show a number of mat holders 6, each of which has a base 8 and side walls 10. In use, a mat is placed on the base 8, within the recess defined by the side walls, and flaps 12 resiliently close down over the edges of the mat, so holding the mat in place.

A number of holes 14 are provided around the edge of the holder 6, beneath the flaps 12. Alternatively, a recess 16 may be provided which extends for a substantial fraction of a side of the holder. A connecting member, which is further described below, fits into the holes 14 or the recesses 16.

Figure 2:
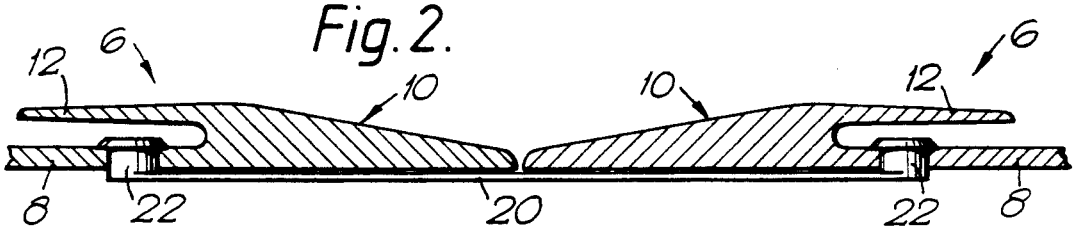
FIG. 2 is a section through the holders of FIG. 1 along the line A—A.

One embodiment of the connecting member is shown in FIGS. 1 and 2. The connecting member 18 consists of an elongated body 20 having, at either end, a lug 22, each of which fits snugly into adjacent holes 14 of two juxtaposed holders 6, in order to hold the two holders together.

Figure 3:
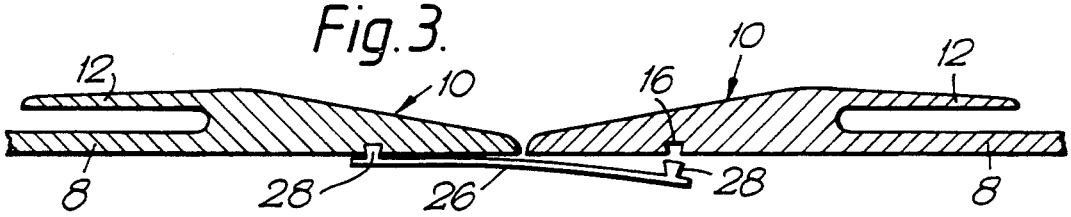
FIG. 3 is a section through the holders of FIG. 1 along the line B—B.
Figure 4:
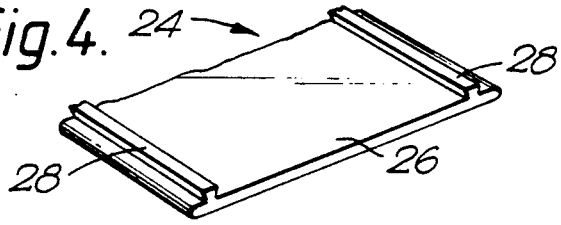
FIG. 4 is a perspective view of one embodiment of the connection member of FIG. 3.

Another embodiment of the connecting member is shown in FIGS. 1, 3 and 4. The connecting member 24 consists of a strip 26 having connecting means, in the form of two ridges 28, which extend for the length of the strip 26. The length of connecting members 24 is intended to be of the same order of magnitude as the length of the edge of the mat holder 6. This means that the connection between two holders is firmer and stronger than with connecting member 18.

Figure 5:
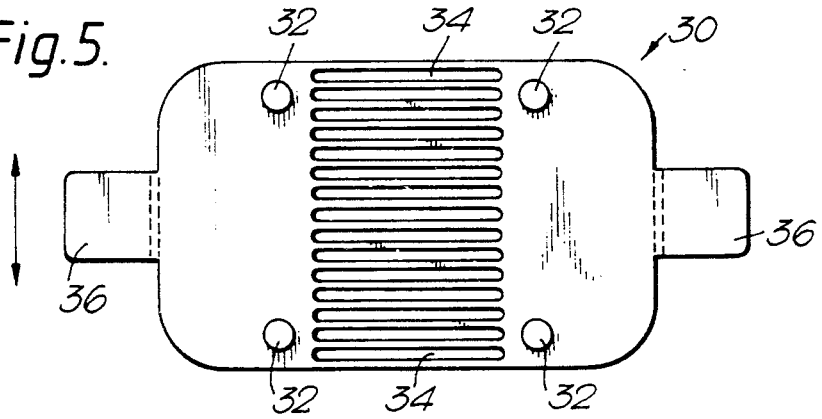
FIG. 5. is a plan view of a further embodiment of a connecting member.

Another embodiment of a connecting member for use with a mat holder is shown in FIG. 5. The connecting member 30 has four lugs 32 and a plurality of elongated slots 34 which extend between the lugs. The slots 34 allow one end of the connecting member 30 to move slightly, in the direction shown by the arrow, relative to the other end. The member 30 may also be provided with a tongue 36 at either end, the purpose of which will be described hereafter.

Figure 6:
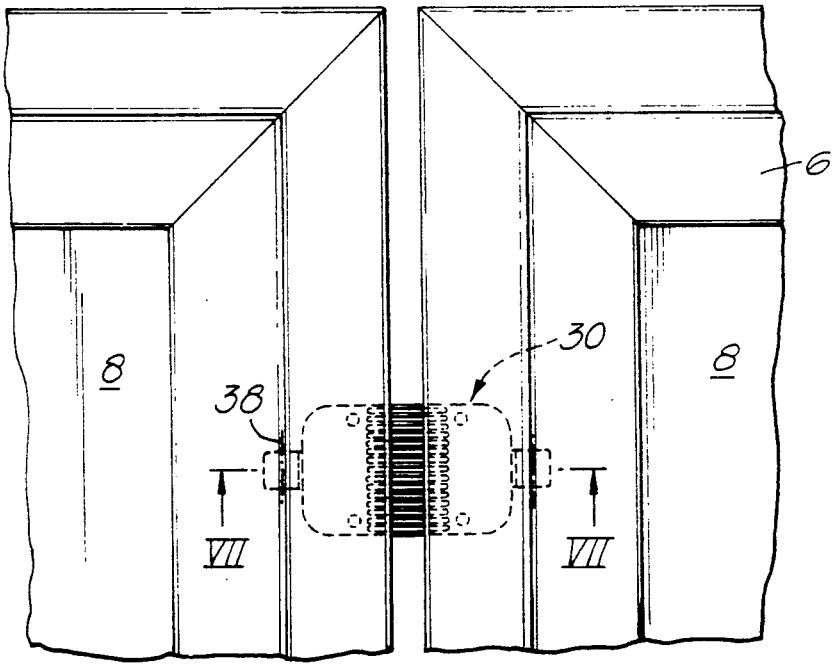
FIG. 6 is a plan view of a mat holder, incorporating the connecting member of FIG. 5.

The lugs 32 of the connecting member 30 are intended to fit snugly within holes 14 provided on the mat holder. The member 30 requires two holes to be provided in the base of the holder, as shown in FIG. 6. The lugs may pass through the base 8, as shown in FIG. 2, or may fit with holes 14 provided in the side walls 10 of the holder as shown in FIG. 7.

Figure 7:
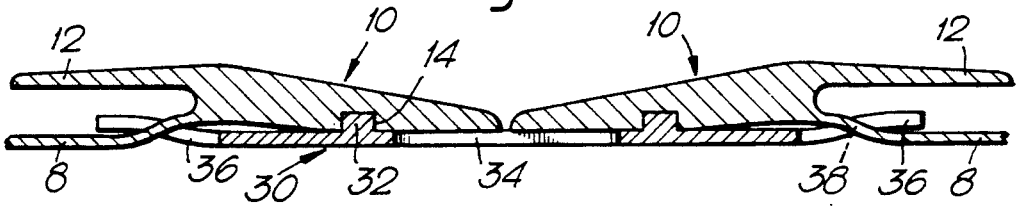
FIG. 7 is a cross-sectional view along the line VII—VII of FIG. 6.

A slit 38 is provided in the base 8 of the holder, adjacent the holes 14 and beneath the flap 12, to accept the tongue 36 of the connecting member 30 as shown in FIGS. 6 and 7. This serves to provide a stronger connection between adjacent holders than would be provided solely by the engagement of the lugs 32 by the holes in the base of the holder.

What we claim is:

1. A holder for a flexible floor mat, the holder comprising:

a base having at least one connecting means; and at least one flexible connecting member means having two ends and at least two complementary connecting means adapted to releasably engage the base connecting means with at least one aperture being defined by the connecting member means at a location between the two complementary connecting means whereby one end of the connecting member means is adapted to move slightly relative to the other end of the connecting member means, in a direction in a plane of the connecting member means perpendicular to said aperture; and whereby the connecting member is adapted to releasably connect at least two adjacent mat holders to secure the holders together.

2. The mat holder according to claim 1, wherein the base and the connecting member are both made from polypropylene.

3. The mat holder according to claim 1, wherein the base connecting means are selected from the group consisting of holes defined by the base, slots defined by the base or lugs.

4. The mat holder according to claims 1 or 3, wherein the complementary connecting means are selected from the group consisting of holes defined by the connecting member, ridges or lugs.

5. The mat holder according to claims 1 or 3, wherein the connecting member further includes at least one tongue portion which is adapted to engage a slot in the base.

6. The mat holder according to claim 4, wherein the connecting member further includes at least one tongue portion which is adapted to engage a slot in the base.

7. The mat holder according to claim 1, wherein the base and the connecting member are both made from a flexible material.

8. The mat holder according to claim 7, wherein the flexible material is selected from the group consisting of rubber or rubber substitutes.

9. A holder for a flexible floor mat, the holder comprising:

a base having at least one connecting means; and at least one flexible connecting member means having two ends and at least two complementary connecting means adapted to releasably engage the base connecting means, the connecting member means defining thin elongated slots which extend between the complementary connecting means whereby one end of the connecting member means is adapted to move slightly relative to the other end of the connecting member means, in a direction in a plane of the connecting member means perpendicular to said slots; and whereby the connecting member is adapted to releasably connect at least two adjacent mat holders to secure the holders together.

10. The mat holder according to claim 9, wherein the base connecting means is selected from the group consisting of holes defined by the base, slots defined by the base or lugs.

11. The mat holder according to claims 9 or 10, wherein the complementary connecting means are selected from the group consisting of holes defined by the connecting member, ridges or lugs.

12. The mat holder according to claims 9 or 10, wherein the connecting member further includes at least one tongue portion which is adapted to engage a slot in the base.

13. The mat holder according to claim 11, wherein the connecting member further includes at least one tongue portion which is adapted to engage a slot in the base.

14. The mat holder according to claim 9, wherein the base and the connecting member are both made from a flexible material.

15. The mat holder according to claim 14, wherein the flexible material is selected from the group consisting of rubber or rubber substitutes.

16. The mat holder according to claim 9, wherein the base and the connecting member are both made from polypropylene.

* * * * *